United States Patent [19]

McCulloch

[11] 4,143,768

[45] Mar. 13, 1979

[54] FOLDED BLANK CONTAINER FOR RECEPTACLES

[75] Inventor: Roger L. McCulloch, La Porte, Ind.

[73] Assignee: Boise Cascade Corporation, Boise, Id.

[21] Appl. No.: 893,935

[22] Filed: Apr. 6, 1978

[51] Int. Cl.[2] ..... B65D 81/02; B65D 85/30

[52] U.S. Cl. ..... 206/590; 229/39 R

[58] Field of Search ..... 229/38, 39 R, 39 B; 206/590

[56] References Cited

U.S. PATENT DOCUMENTS

| | | | |
|---|---|---|---|
| 1,039,026 | 9/1912 | Carter | 229/39 B |
| 2,046,562 | 7/1936 | Kant et al. | 229/38 |
| 2,444,895 | 7/1948 | Ringler | 229/39 R |
| 2,448,401 | 8/1948 | Stone | 206/590 |
| 2,491,663 | 12/1949 | Hultin | 229/38 |
| 2,531,090 | 11/1950 | Turner | 229/39 R |
| 2,682,949 | 7/1954 | Whitehead | 206/590 |

FOREIGN PATENT DOCUMENTS

| | | | |
|---|---|---|---|
| 1233598 | 5/1971 | United Kingdom | 229/39 B |

*Primary Examiner*—William Price

*Assistant Examiner*—Joseph Man-Fu Moy

*Attorney, Agent, or Firm*—Lawrence E. Laubscher

[57] ABSTRACT

A wrap-around container blank is disclosed for forming a shipping container for a relatively large receptacle having an upwardly extending neck portion, characterized by the provision of three superimposed horizontal top panels for protecting the neck portion of the receptacle, thereby to permit stacking of the containers without damaging the receptacles packaged therein. A lowermost first top panel is adapted to be folded to a horizontal position adjacent the upper surface of the body portion of the receptacle, which top panel contains an opening through which the neck portion of the receptacle extends. The second and third top panels are foldable toward superimposed contiguous horizontal positions spaced above the first panel adjacent the upper extremity of the receptacle neck portion, thereby stabilizing the receptacle within the container. Preferably, the first, second and third top panels are provided at their free ends with vertical support tabs which assist in supporting the top panels in their horizontal positions, thereby strengthening the top portion of the resulting container.

7 Claims, 7 Drawing Figures

Fig. 4
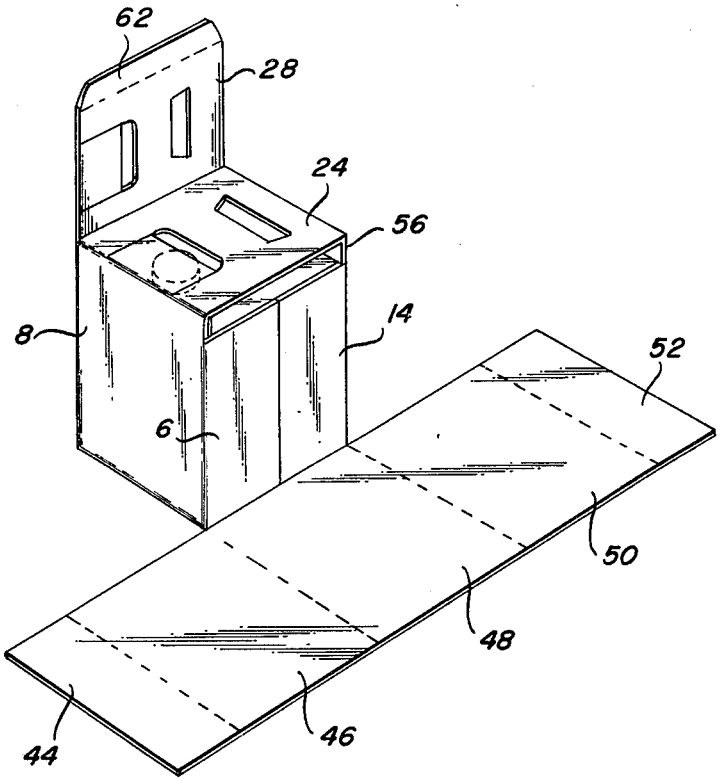
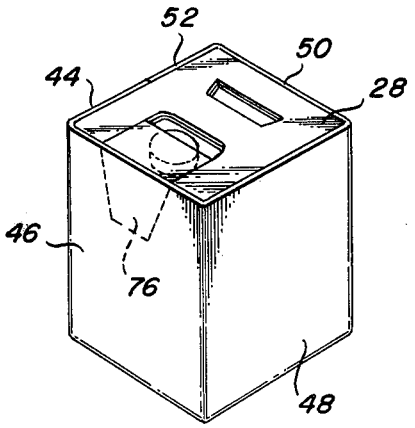
Fig. 5

FOLDED BLANK CONTAINER FOR RECEPTACLES

BRIEF DESCRIPTION OF THE PRIOR ART

Reinforced corrugated shipping containers having side, top and bottom walls of multiple thicknesses are well known in the patented prior art, as evidenced by the U.S. Patents to Keith, Nos. 3,069,062, 3,286,900, and 3,342,398, and the U.S. Pat. to Fallert, No. 3,189,249.

One problem inherent to the design of corrugated shipping cartons for large relatively weak receptacles, such as synthetic plastic jugs or bottles, is that of adequately protecting the neck portions of the receptacles so as to permit stacking of the packaged cartons. Furthermore, it is desired to support the neck portions of the receptacles in such a manner that not only is the receptacle stabilized and protectively supported within the carton, but also access to the neck portion is provided for filling the packaged receptacles, or for dispensing liquids therefrom. Owing to the relatively large size of the receptacles, it is desirable to provide a container blank that is foldable about the receptacle during the packaging operation, and which has multi-layered top, bottom and side walls, whereby the resulting carton has sufficient strength to permit stacking when the receptacles packaged therein are in a filled condition.

SUMMARY OF THE INVENTION

Accordingly, the primary object of the present invention is to provide a wrap-around container blank for large relatively weak receptacles, such as synthetic plastic jugs or bottles, including at least three horizontal superimposed top panels, the lowermost top panel being arranged to engage the upper surface of the body portion of the receptacle and containing an opening through which the receptacle neck portion extends, the remaining two top panels being foldable toward contiguous horizontal positions in spaced relation above the lowermost top panel and in engagement with the upper extremity of the neck portion of the receptacle. The wrap-around blank may also include a plurality of superimposed bottom panels, side panels, and front and rear panels, thereby to form a stackable carton of great structural strength.

In accordance with a more specific object of the invention, the upper two top panels are provided at their free ends with downwardly depending support tabs which engage the upper ends of the opposed carton walls to support these two top panels in their horizontal positions. Similarly, the free end of the lowermost top panel may be provided with an upwardly extending support tab that may be glued or otherwise secured to the opposed carton wall to support the lowermost top panel in its horizontal position. The support tabs thus provide a top wall capable of withstanding a vertical stress in order to protect the neck portion of a large relatively weak receptacle.

In accordance with a further object of the invention, there is provided a wrap-around container in which the uppermost two top walls contain cooperating perforated portions which may be partially torn away to provide access to the neck portion of a receptacle packaged within the container, thereby to permit dispensing of fluid therefrom. Preferably, the container or carton is provided with hand grip openings for lifting of the relatively heavy filled container package during the transport and handling thereof.

BRIEF DESCRIPTION OF THE FIGURES

Other objects and advantages of the invention will become apparent from a study of the following specification when viewed in the light of the accompanying drawings, in which:

FIGS. 2–5 are perspective views illustrating the wrap-around assembly steps for forming a container from the blank of FIG. 1;

DETAILED DESCRIPTION

Figure 1:
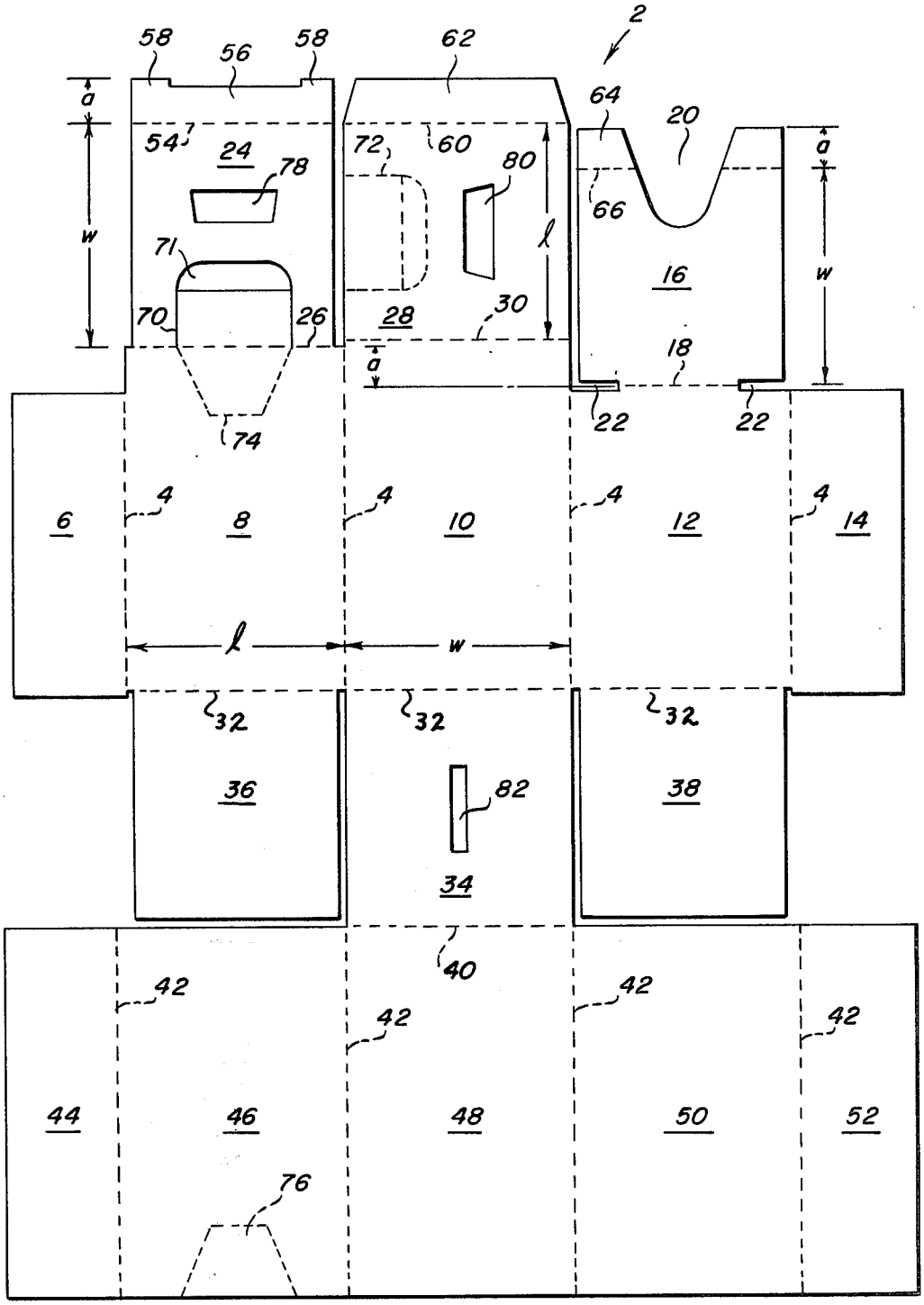
FIG. 1 is a plan view of the container blank.

Referring first more particularly to FIG. 1, the container blank 2 includes a plurality of parallel, spaced, vertical fold lines 4 which define a first front portion 6, a first side panel 8, a rear panel 10, a second side panel 12, and a second front portion 14, the portions 6 and 14 cooperating to form a front panel. A first top panel 16 is connected with the upper edge of the second side panel 12 by a horizontal second fold line 18. The first top panel has a length equal to the width w of the rear panel 10. The first top panel also includes a neck receiving portion in its edge opposite the second side panel 12 and cutaway portions 22 adjacent the second fold line 18. A second top panel 24 is connected with the upper edge of the first side panel 8 by a horizontal third fold line 26. The fold line 26 is at a higher elevation than the fold line 18 by a distance a which is generally equal to the height of the neck portion of the receptacle which is to be packaged. The second top panel 24 has a length equal to the width w of the rear panel 10. A third top panel 28 is connected with the upper edge of the rear panel 10 by a horizontal fourth fold line 30. The length l of the third top panel 28 is equal to the width l of the first side panel 8.

Connected with the lower edge of the rear panel 10 by a horizontal eighth fold line 32 is a first bottom panel 34. Second and third bottom panels 36, 38 are connected with the lower edges of the side panels 8 and 10, respectively, by the eighth fold line 32. An outer wall is connected with the lower edge of the bottom panel 34 by a horizontal ninth fold line 40. A plurality of parallel, spaced, vertical fold lines 42 in the outer wall define a first outer rear portion 44, a first outer side portion 46, an outer front portion 48, a second outer side portion 50, and a second outer rear portion 52, the portions 44 and 52 cooperating to form the outer rear panel.

Adjacent each of the top panels are provided support tabs. Connected with the second top panel 24 by horizontal fold line 54 is a support tab 56 having a key portion 58 which cooperates with the cutaway portion 22 adjacent the fold line 18 to be discussed more fully hereinafter. Connected with the upper edge of the third top panel 28 by a horizontal fold line 60 is a support tab 62, and a support tab 64 is also connected with the upper edge of the first top panel 16 by a horizontal fold line 66. All of the support tabs 56, 62, 64 have a length generally equal to the height of the neck portion of an article being contained.

Figure 2:
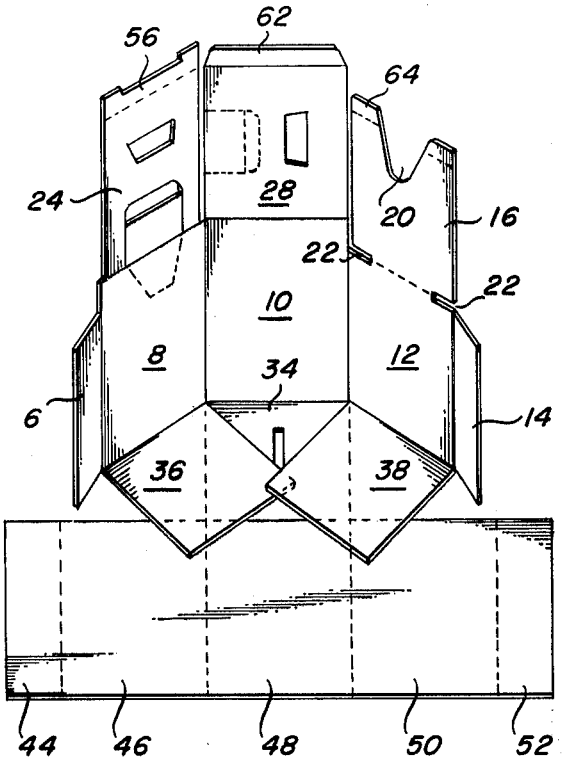

The formation of a shipping container from the blank 2 is shown in FIGS. 2-5. The blank is first folded upwardly about the fold line 32 and then folded into a tubular configuration along the fold lines 4 whereby the panels 6, 8, 10, 12 and 14 form the inner walls of the container and surround the receptacle being packaged. Folding along the fold lines 4 also causes the second and third bottom panels 36, 38 to overlie the first bottom panel 34 to form a three-layered bottom wall as shown in FIG. 2. The first top panel 16 is next folded downwardly about fold line 18 to a horizontal position (FIG. 3), the neck portion 68 of the jug extending upwardly through the neck receiving portion 20 of the first top panel as shown in FIG. 4. The support tab 64 is folded upwardly along the fold line 66 (see also FIG. 6) to a support position. The tab 64 may be secured to the inner surface of the side wall 8, if desired, by any conventional liquid adhesive to further strengthen the container.

Figure 6:
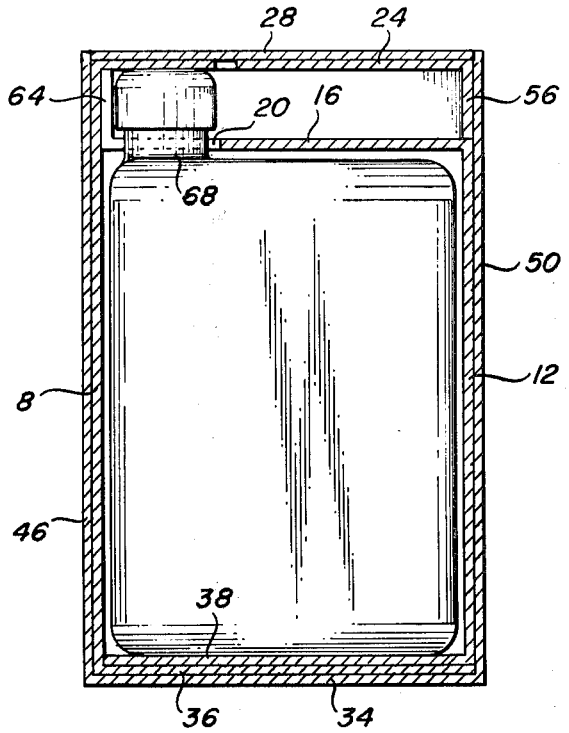
FIG. 6 is a front sectional view of the closed container for a receptacle having a neck portion.
Figure 7:
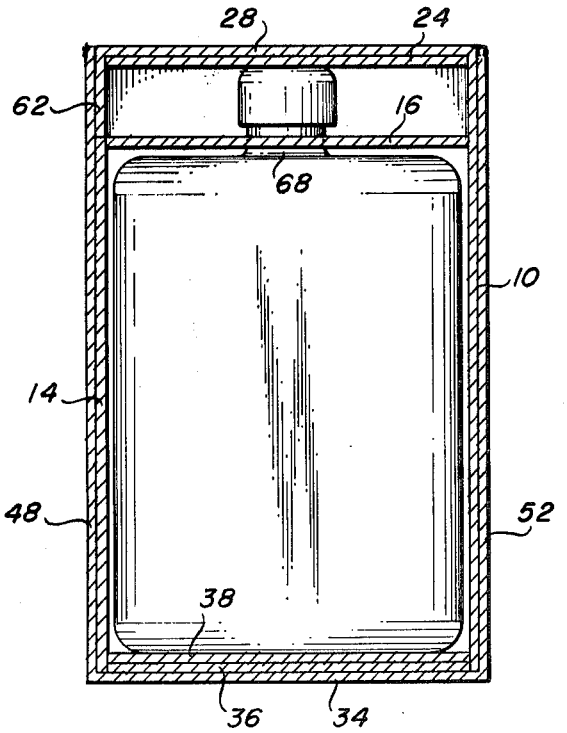
FIG. 7 is a right side sectional view of the closed container.

The second top panel 24 is next folded downwardly along the fold line 26 to a superimposed horizontal position adjacent the top of the article neck portion 68 in spaced relation from the first top panel 16. The support tab 56 is then folded downwardly along the fold line 54 to a vertical position, the key portions 58 cooperating with the cutaway portions 22 so that the free edge of the support tab 56 rests in supporting engagement with the upper end of the side panel 12 (FIG. 6). The support tab 64 serves to support the edge of the second top panel 24 adjacent the fold line 26.

The third top panel 28 is next folded downwardly along the fold line 30 to a horizontal position contiguous with the second top panel 24. Then the support tab 62 is folded downwardly along the fold line 60 to a vertical position in supporting engagement with the upper end of the front panel formed from the portions 6 and 14.

It is readily apparent that the three layered top wall of the container holds the jug and its upwardly extending neck portion in a protected fashion and also provides a flat, supported top wall which facilitates the stacking of a plurality of containers.

Figure 3:
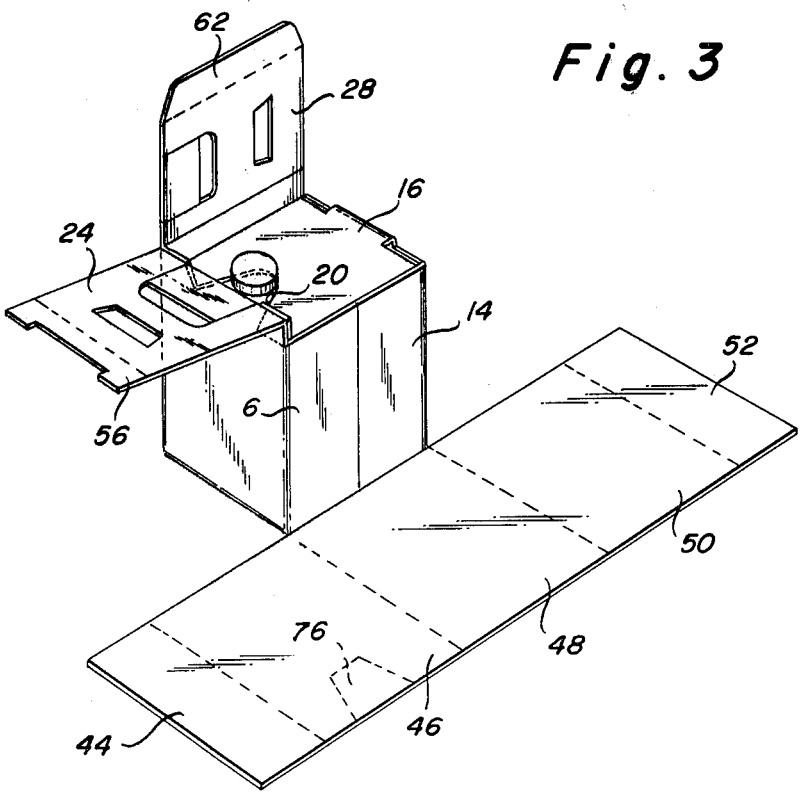

The remaining portion of the blank of FIG. 3 is folded upwardly along the fold line 40 and then into a tubular configuration contiguous with the inner wall along the fold lines 42. The panels 44, 46, 48, 50 and 52 form the outer wall of the container, the panels 44 and 52 cooperating to form the outer rear wall. The inner surface of the outer wall may be coated with a conventional liquid adhesive to seal the outer wall in closing relation with the inner wall, and the support tabs 56 and 62, respectively.

In a preferred embodiment, a perforated portion 70 and a cut-out portion 71 may be provided in the second top panel 24 adjacent the fold line 26 and a perforated portion 72 may be provided adjacent the left edge of the third top panel 28 so that when the blank is folded, the perforated portions are arranged opposite the neck portion of the article. Similar perforated portions 74, 76 may be provided in side wall 8 adjacent the fold line 26 and in the side wall 46 adjacent its lower free edge. Thus in normal operation, the blank may be folded around an empty jug having a neck portion which is made of a destructible material such as plastic or glass. Prior to sealing the container into its closed condition, the container may be sent to a plant where the jug is filled, following which the container is sealed for shipment. At the destination, the user may tear the perforated portions 70, 72 to afford access to the neck portion of the jug and dispense the contents therefrom without having to open the entire container. This feature is particularly useful in shipping jugs which contain chemicals, acids, and the like.

Aligned apertures 78 and 80 may be provided in the second and third top panels 24 and 28 respectively, and apertures 82 may be provided in the first bottom panel 10, thereby to provide handles for ease of manipulation of the container by the user.

While in accordance with the provisions of the Patent Statutes, the preferred form and embodiment of the invention has been illustrated and described, it will be apparent to those skilled in the art that other changes and modifications may be made without deviating from the inventive concept set forth above.

What is claimed is:

1. A unitary rectangular blank for forming a shipping container for an article, such as a jug, having an upwardly extending neck portion, said blank including (a) a plurality of parallel spaced vertical first fold lines defining opposed front and rear panels and a pair of opposed side panels;

(b) a first top panel connected with the upper edge of one of said side panels by a horizontal second fold line;

(c) a second top panel connected with the upper edge of the other of said side panels by a horizontal third fold line, the length of said second top panel being equal to the width of said rear panel;

(d) a third top panel connected with the upper edge of said rear panel by a horizontal fourth fold line, the length of said third top panel being equal to the width of said third side panel;

(e) said third fold line being vertically arranged at a higher elevation than said second fold line by a first distance that corresponds generally with the height of the article neck portion, said first top panel containing a neck-receiving opening;

(f) said front, rear and side panels being foldable to define a first hollow tube for receiving the article, said first top panel being foldable downwardly to a horizontal position in which the article neck portion extends through said neck-receiving opening, said second and third top panels being foldable downwardly toward superimposed contiguous horizontal positions in spaced relation above said first panel;

(g) first support tab means connected with the free end of said second top panel by horizontal fifth fold lines, the length of said first support tab means being equal to said first distance, the free extremity of said first support tab means including locking tongue means adapted for insertion within corresponding locking slot means contained in said second fold line;

(h) second support tab means connected with the free end of said third top panel by horizontal sixth fold lines, the length of said second support tab means being equal to said first distance, whereby when said second top panel is folded to the horizontal position and said first support tab means are folded vertically downwardly into supporting engagement with the upper end of the adjacent side panel, the free end of said second top panel is supported by said first support tab means, and when said third top panel is folded to the horizontal position and said second support tab means are folded vertically downwardly into supporting engagement with the upper end of the adjacent front panel, the free end of said third top panel is supported by said second support tab means.

2. A blank as defined in claim 1, wherein the length of said first top panel equals the width of said rear panel, and further including third support tab means connected with the free end of said first top panel by horizontal seventh fold lines, the length of said third support tab means being generally equal to said first distance, whereby when said first top panel is folded to the horizontal position and said third support tab means are folded vertically upwardly and said second top panel is folded to the horizontal position, the end of said second top panel adjacent said third fold line is supported by said third support tab means.

3. A blank as defined in claim 2, wherein said third support tab means are secured to the inner surface of said other side panel.

4. A blank as defined in claim 2, and further including a bottom panel connected at its upper edge with the lower edge of said rear panel by a horizontal eighth fold line, said bottom panel being foldable upwardly to a horizontal position to form the bottom of the container.

5. A blank as defined in claim 4, and further including an outer front panel connected with the lower edge of said bottom panel by a horizontal ninth fold line, said outer front panel being foldable upwardly to a vertical position adjacent and secured to the outer surface of both said front panel and second support tab means, respectively, thereby to close the container.

6. A blank as defined in claim 5, and further including outer side and rear panels connected with said outer front panel by vertical tenth fold lines, said outer front, rear and side panels being foldable to define an outer tube contiguous with and secured to the outer surfaces of said first hollow tube and said first and second support tab means, respectively, thereby to close said container.

7. A blank as defined in claim 1, wherein said second top panel contains a perforated portion adjacent said third fold line and said third top panel contains a perforated portion adjacent its left side edge, whereby when said blank is folded, said perforated portions are contiguously arranged opposite the article neck portion, said perforated portions being at least partially severable to provide access to the article neck portion.

* * * * *